United States Patent [19]

Sinclair

[11] 4,176,731

[45] Dec. 4, 1979

[54] TWO-SECTION EXPONENTIAL ACOUSTICAL HORN

[75] Inventor: Rex Sinclair, Garden Grove, Calif.

[73] Assignee: Altec Corporation, Anaheim, Calif.

[21] Appl. No.: 853,204

[22] Filed: Nov. 21, 1977

[51] Int. Cl.[2] ..... G10K 11/00

[52] U.S. Cl. ..... 181/192; 181/187

[58] Field of Search ..... 181/192, 193, 194, 187, 181/180

[56] References Cited

U.S. PATENT DOCUMENTS

| | | | |
|---|---|---|---|
| 2,203,875 | 6/1940 | Olson | 181/187 |
| 2,338,262 | 1/1944 | Salmon | 181/192 |
| 2,537,141 | 1/1951 | Klipsch | 181/187 |
| 3,930,561 | 1/1976 | Klayman | 181/187 |
| 3,935,925 | 2/1976 | Koiwa et al. | 181/192 |
| 4,071,112 | 1/1978 | Keele, Jr. | 181/187 |

FOREIGN PATENT DOCUMENTS

| | | | |
|---|---|---|---|
| 952179 | 11/1956 | Fed. Rep. of Germany | 181/192 |
| 315561 | 7/1929 | United Kingdom | 181/192 |

*Primary Examiner*—Stephen J. Tomsky
*Attorney, Agent, or Firm*—Edward A. Sokolski

[57] ABSTRACT

An acoustical horn suitable for use in conjunction with an acoustical driver to form a loudspeaker has a first section between its throat and a predetermined point therealong which has a first exponential flare rate, and a second section between the predetermined point and the mouth which has a second flare rate. The flare rates are chosen to afford improved frequency response over a single section exponential horn with the same length, mouth area and throat area.

6 Claims, 6 Drawing Figures

TWO-SECTION EXPONENTIAL ACOUSTICAL HORN

This invention relates to acoustical horns for loudspeakers, and more particularly to such a horn having two exponential sections which have different flare rates.

Horns are generally employed in loudspeakers for radiating acoustical signals in the intermediate and high frequency ranges. A single section flared horn having an improved low frequency response over a conventional exponentially flared horn is described in U.S. Pat. No. 2,338,262 issued Jan. 4, 1944, to V. Salmon. The horn of the Salmon patent is flared in accordance with a hyberbolic function. This horn, however, has greater distortion than a conventional exponential horn. It has been found that by dividing the horn into two sections which have different predetermined exponential flare rates, the improved low frequency response achieved by Salmon can be attained without an attendant increase in distortion. A two-section horn having different flare rates in each section principally in order to achieve a controlled radiation pattern is described in U.S. Pat. No. 2,537,141 to P. W. Klipsch, Jan. 9, 1951. Thus, the horn of the present invention provides an improvement over the horn of the Salmon patent in that it affords equivalent frequency response along with less distortion for a given length, mouth area and throat area, and an improvement over the horn of the Klipsch patent in frequency response for a given length, mouth area and throat area.

It is therefore an object of this invention to provide a horn loudspeaker having improved frequency response and/or less distortion than prior art horn loudspeakers.

It is a further object of this invention to provide a relatively simple horn loudspeaker having improved response characteristics.

Other objects of this invention will become apparent as the description proceeds in connection with the accompanying drawings.

For simplicity of presentation the preferred embodiment shown is for horns of circular cross-section, whereas any horn having the same cross-sectional areas at the same distances from the driver should be considered equivalent in function to the preferred embodiment. In the following drawings.

Briefly described, the horn loudspeaker of my invention is as follows: A horn for a loudspeaker has a first section between its throat and a point therealong which has a first predetermined flare rate and a second section between this point and the mouth of the horn which has a second predetermined flare rate, both these flare rates being defined by predetermined equations. These two flare rates are chosen to provide improved frequency response and minimum distortion.

Figure 1:
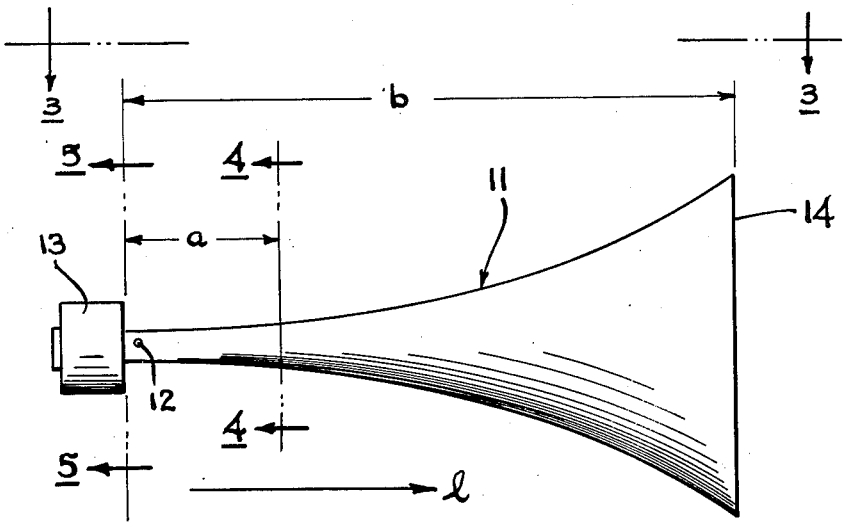
FIG. 1 is a side elevational view of a preferred embodiment of the invention.
Figure 2:
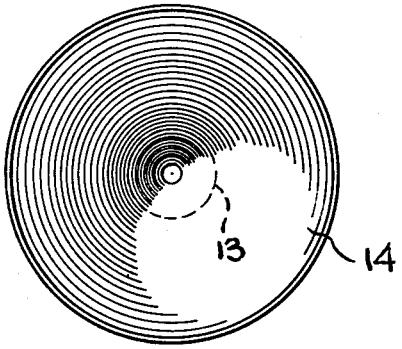
FIG. 2 is an end elevational view of the preferred embodiment.
Figure 3:
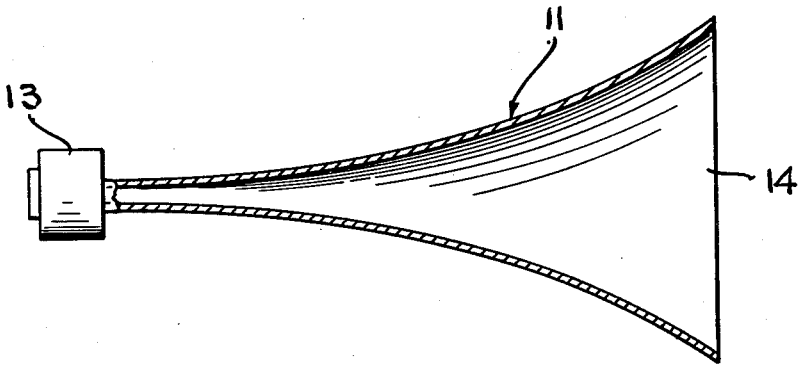
FIG. 3 is a cross-sectional view of the preferred embodiment taken along the plane indicated by 3—3 in FIG. 1.
Figure 4:
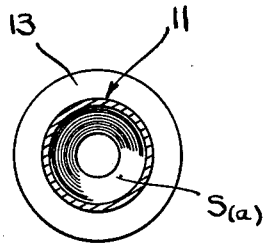
FIG. 4 is a cross-sectional view taken along the plane indicated by 4—4 in FIG. 1.
Figure 5:
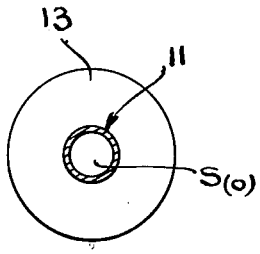
FIG. 5 is a cross-sectional view taken along the plane indicated by 5—5 in FIG. 1.

Referring now to FIGS. 1–5, a preferred embodiment of the invention is shown. Horn 11 receives acoustical energy at its throat portion 12 from acoustical driver 13 which is coupled thereto. Horn 11 has a circular transverse cross-section throughout its extent, as can be seen in FIGS. 2, 4 and 5. Horn 11 has a first flare rate, $m_1$, between throat 12 and cross-section 4—4, and a second flare rate, $m_2$, between cross-section 4—4 and the throat 14 of the horn. Flare rates $m_1$ and $m_2$ are defined as follows:

$$m_1 = m + (2/b) \ln R \quad (1)$$

$$m_2 = m - (2/b - a) \ln R \quad (2)$$

where R has a value between 0.8 and 1, a is the distance between throat 12 and the point of cross-section 4—4 as shown in FIG. 1, b is the distance between throat 12 and mouth 14 as shown in FIG. 1, and m is the flare rate constant of a single section exponential horn having the same throat area, mouth area and length as the two-section horn herein described, which is determined as follows:

$$m = (4\pi fc/C) \quad (3)$$

where fc is the theoretical cutoff frequency of the horn and C is the speed of sound in the propagation medium.

It is to be noted that $m_1 < m < m_2$ in view of the fact that $\ln R < O$ and therefore is negative.

For distances, l (see FIG. 1) between throat 12 and the point of cross-section 4—4, the cross-sectional area S(l) at any point is defined as follows:

$$S(l)_1 = S(o)e^{m1l} \quad (4)$$

where S(o) is the cross-sectional area at the throat as shown in FIG. 5.

For distances, l, between the point of cross-section 4—4 (FIG. 1) and throat 14, the cross-section area, S(l) is as follows:

$$S(l)_2 = S(a)e^{m2(l-a)}, \quad (5)$$

where S(a) is the area of horn cross-section 4—4 (see FIG. 4).

It has been found that good frequency response can be obtained in the device of the invention where $0.8 < R < 1$ and $0.1b < a < 0.35b$, with optimum frequency response where R is equal to 0.9 and a equals 0.25b. Substituting in equations (1) and (2), this gives optimum values for $m_1$ and $m_2$ as follows:

$$m_1 = m - (0.843/b) \quad (6)$$

$$m_2 = m + (0.281/b) \quad (7)$$

where m = the flare constant of a single section horn of the same throat area, mouth area and length.

It has been found that the frequency response of a horn in accordance with the present invention is at least equal to that of a horn designed according to the aforementioned U.S. Pat. No. 2,338,262, having the same mouth and throat area as well as the same length. The device of the present invention, however, has less distortion than that of this prior art horn. It has also been found that the flare rate, $m_1$ for the section between the throat and cross-section 4—4 can be that of a cone provided that the cross-sectional area S(a) at 4—4 is somewhere between $0.8S(o)e^{ma}$ and $S(o)e^{ma}$.

Rectangular section, re-entrant, folded, sectoral and multicell horns can all be designed employing the principle of the present invention.

Figure 6:
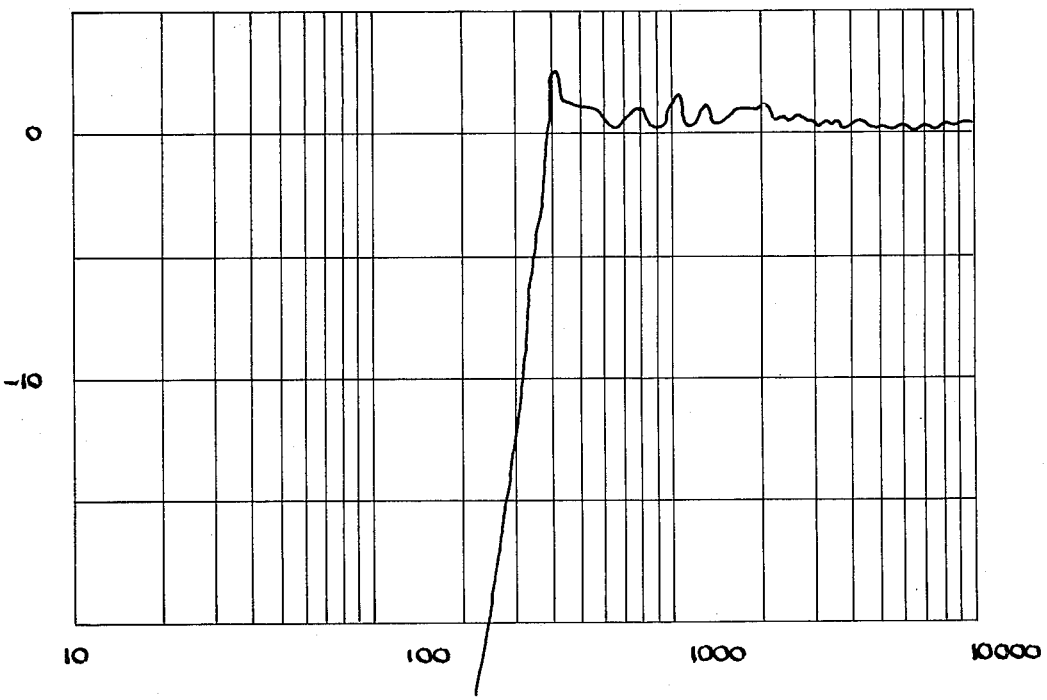
FIG. 6 is a response curve of a typical horn loudspeaker of the preferred embodiment of the invention.

Referring now to FIG. 6, a response curve is shown for a horn of this invention having the following parameters:

Throat area, S(0)=0.7865 sq.in.;
Mouth area=110.88 sq.in.;
Length, b=16.5 inches;
R=0.9;
a=0.3030b;
m=0.3000;
$m_1$=0.2579;
$m_2$=0.3183.

While the invention has been described and illustrated in detail, it is to be clearly understood that this is intended by way of illustration and example only and is not to be taken by way of limitation, the spirit and scope of this invention being limited only by the terms of the following claims.

I claim:

1. A two-section exponential horn comprising:

a first section between the throat of the horn and a predetermined point therealong having a first exponential flare rate, $m_1$, and a second section between said predetermined point and the mouth of the horn having a second exponential flare rate, $m_2$, which is greater than $m_1$.

2. The horn of claim 1 wherein the distance (a) between the throat of the horn and said predetermined point therealong is equal to one-fourth the distance (b) between the throat and mouth of the horn.

3. The horn of claim 1 wherein $$m_1=m-(0.843/b) \text{ and } m_2=m+(0.281/b$$

where b is the distance between the mouth and throat of the horn.

4. The horn of claim 1 wherein the cross-sectional area, $S(l)_1$ of the horn at any point between the throat of the horn and said predetermined point therealong is defined by:

$$S(l)_1=S(o)e^{m1l}$$

and the cross-sectional area, $S(l)_2$ of the horn at any point between said predetermined point and the mouth of the horn is defined by:

$$S(l)_2=S(a)e^{m2(1-a)}$$

where S(o) is the cross-sectional area of the throat of the horn, S(a) is the cross-sectional area at said predetermined point, and l is the distance of the point of the cross-sectional area from the throat of the horn.

5. The horn of claim 4 wherein R is equal to 0.9.

6. The horn of claim 5 wherein a is equal to 0.25b.

* * * * *